US005297697A

United States Patent [19]

Boring

[11] Patent Number: 5,297,697

[45] Date of Patent: Mar. 29, 1994

[54] CAULK CARTRIDGE WITH VALVE CONTROL

[75] Inventor: David E. Boring, East Berlin, Pa.

[73] Assignee: Sonoco Products Company, Hartsville, S.C.

[21] Appl. No.: 95,467

[22] Filed: Jul. 23, 1993

[51] Int. Cl.[5] ..... B67D 5/00

[52] U.S. Cl. ..... 222/83; 222/82; 222/541; 222/543; 222/568; 137/68.1; 239/541; 251/149.4

[58] Field of Search ..... 222/81, 82, 83, 326, 222/327, 541, 543, 559, 568; 137/68.1; 239/541; 251/149.4

[56] References Cited

U.S. PATENT DOCUMENTS

| | | | |
|---|---|---|---|
| 2,833,450 | 7/1956 | Sherbondy . | |
| 2,873,886 | 2/1959 | Miskel et al. | 222/568 X |
| 3,136,456 | 6/1961 | Sherbondy . | |
| 3,193,146 | 7/1965 | Isgriggs et al. | 222/82 |
| 3,219,278 | 11/1965 | Santarelli | 239/541 X |
| 3,640,431 | 2/1972 | Plumer . | |
| 3,658,213 | 4/1972 | Plumer . | |
| 4,284,213 | 8/1981 | Lee | 222/541 |
| 4,461,454 | 7/1984 | Vadnais . | |
| 4,546,906 | 10/1985 | Vadnais | 222/541 X |
| 4,802,607 | 2/1989 | Johnson . | |
| 4,862,918 | 9/1989 | Schroeder | 251/149.4 X |
| 5,154,327 | 10/1992 | Long . | |

FOREIGN PATENT DOCUMENTS

| | | | |
|---|---|---|---|
| 598208 | 12/1925 | France | 251/149.4 |

*Primary Examiner*—Gregory L. Huson

*Attorney, Agent, or Firm*—Dennison, Meserole, Pollack & Scheiner

[57] ABSTRACT

A caulk cartridge including an end closure having a centrally extending mounting stub with a reciprocating valve positioned therein. A nozzle is thread mounted to the stub with inward threading of the nozzle engaging and inwardly shifting the valve to an open position for discharge therethrough. Outward retraction of the nozzle releases the valve for a reseating of the valve.

23 Claims, 2 Drawing Sheets

CAULK CARTRIDGE WITH VALVE CONTROL

BACKGROUND OF THE INVENTION

The invention generally relates to cartridges commonly used for the dispensing of mastic type adhesives, sealants, and the like.

Such cartridges basically consist of a substantially rigid tube of cardboard or appropriate synthetic resinous material such as polyethylene within which the contents are sealed by opposed end closures. A forward end closure conventionally mounts a discharge nozzle through which the contents are ejected. The opposite rear end closure is selectively forwardly slid within the tube for a forward discharge of the contents through the nozzle.

The cartridge, at the discharge end thereof, is frequently sealed by an impermeable membrane provided across the end of the tube immediately inward of the end closure. In addition, the mounted nozzle will normally be of an outwardly tapering configuration terminating in a sealed end. Thus, an opening of the cartridge for discharge of the contents involves both a severing of the tip portion of the nozzle and a breaking of the inner membrane, both functions requiring an appropriate sharp implement such as a knife or the like. The difficulties of opening conventional cartridges for use have not infrequently resulted in injuries to the user, particularly to the non-professional.

Another problem frequently encountered with known caulk cartridges is the difficulty in resealing a partially used cartridge for both preserving the unused contents and maintaining the discharge apparatus for practical reuse. One common expedient for resealing the cartridge involves the use of a separate end cap which is frictional engaged over the cut tip of the nozzle. Such end caps are frequently misplaced or accidentally dropped from the nozzle, thus exposing the contents to the atmosphere.

SUMMARY OF THE INVENTION

The caulk cartridge of the present invention is specifically concerned with the provision of effective means for both opening and resealing the cartridge.

A related object of the invention is to provide for the opening of the cartridge without requiring the use of a separate cutting implement, and to provide for the resealing without the necessity for utilizing an external cap or lid.

Another significant feature of the invention is the avoidance of the necessity of a permanently mounted projected nozzle. Rather, the cartridge of the invention utilizes a removable nozzle which, upon mounting, automatically opens the cartridge for the dispensing of the contents through the nozzle, and, upon a removal of the nozzle, provides for a resultant resealing of the cartridge and a preservation of the remaining contents.

The principal advantages of the invention are achieved utilizing a valve reciprocally mounted within a centrally projecting externally threaded hollow stub or nozzle base integral with the closure plate at the discharge end of the cartridge. The valve includes an inner end which peripherally seals against a seat defined at the inner end of the stub. The nozzle threadedly mounts on the stub and, upon mounting, inwardly engages against the outer end of the valve causing an inward sliding of the valve and an unseating of the inner end for an exposure of flow passages through which the cartridge contents are discharged into and through the aligned nozzle.

Upon removal of the nozzle, the valve is unrestrained and free to outwardly shift to its sealed This outward shifting of the valve is easily effected by the application of dispensing pressure to the cartridge contents. The base end of the valve will affectively seat and seal, with the sealing being enhanced by residue of the contents between the sealing surfaces.

As desired, and in order to obtain maximum shelf life prior to the initial use of the cartridge, an appropriate sealing membrane can be provided below and in alignment with the valve for subsequent rupture by the valve as the valve is initially inwardly shifted. In addition, it is contemplated that the nozzle be loosely tethered to the mounting stub to allow removal without fear of misplacement.

Other features and advantages of the invention are considered to reside in the specific details thereof as more particularly herein set forth.

DESCRIPTION OF PREFERRED EMBODIMENTS

Figure 1:
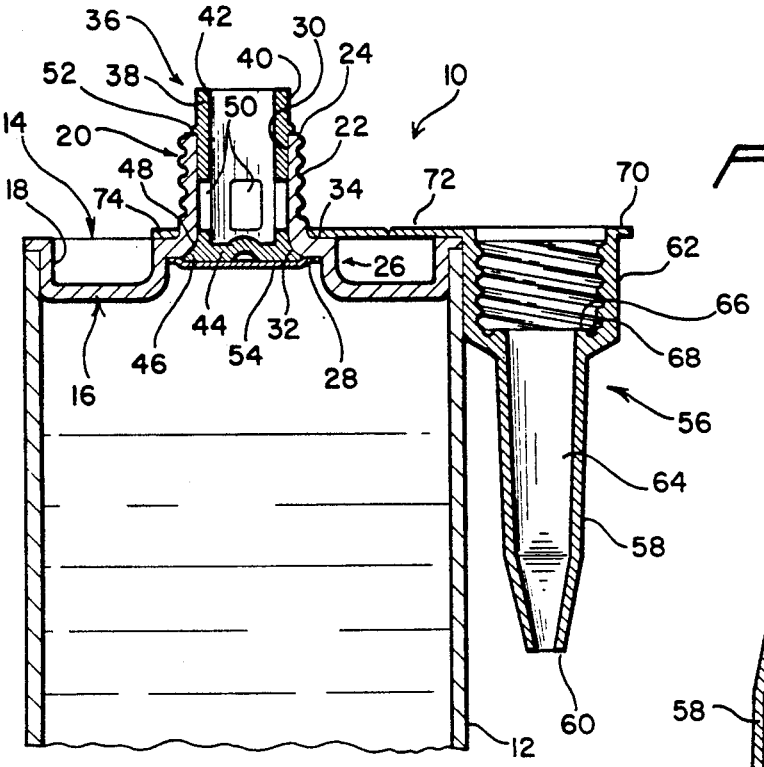
FIG. 1 is a cross-sectional view of the discharge end portion of the caulk cartridge prior to its initial use.

Referring now more specifically to the drawings, the dispensing cartridge 10, commonly referred to as a caulk cartridge, basically comprises an elongate substantially rigid tube 12 of appropriate material such as cardboard or polyethylene, and opposed end closures which, in combination with the tube, define a container for the flowable material to be pressure dispensed.

The invention is principally concerned with the discharge end of the cartridge 10 wherein the end closure is designated by reference numeral 14. This end closure 14, formed of an appropriate material such as metal or preferably a synthetic resinous material as conventional in such end closures or caps, includes a circular closure plate 16 with inner and outer sides. The closure plate 16 is of a size and configuration so as to seal the entire end of the cartridge tube 12 and is sealed thereto in an airtight manner as is common in caulk tubes. For example, as illustrated, the end plate can be slightly recessed within the tube 12 and include an outwardly directed annular flange 18 which engages over the annular end portion of the tube 12 and is bonded or crimped thereto.

A centrally positioned, outwardly extending, hollow cylindrical mounting stub 20 is integrally formed with the closure plate 16 and defines a flow passage therethrough between the interior and exterior of the tube 12. The mounting stub 20 includes an elongate externally threaded cylindrical outer portion 22 having a smooth cylindrical bore 30 therethrough and terminating in a free, open, annular outer end 24. A hollow cylindrical inner portion 26 is integral and coaxial with the outer portion 22 and radially enlarged to define a downwardly directed annular shoulder 28 at the lower end of the bore 30 defined through the outer portion 22. The shoulder 28, particularly at the arcuate annular edge portion 32 thereof at the inner end of the bore 30, defines a valve seat as will be referred to in more detail subsequently. It will be noted that the enlarged inner portion 26 also forms an outwardly directed or outer shoulder 34 at the joinder with the threaded outer portion 22.

In addition to the mounting stub 20, the control for the dispensing of the contents of the cartridge 10 includes a valve or valve insert 36. The valve includes an elongate hollow cylindrical body or stem 38 having a smooth exterior surface 40 which compliments and slidably seals to the interior bore 30 of the mounting stub 20.

The tubular body 38 of the valve 36 includes a free outer end 42 and an inner end closed by an integral transverse end cap 44. An integral annular sealing flange 46 surrounds the lower end of the valve body 38 and presents an upwardly directed, preferably arcuate surface 48 which defines a valve head which engages against and defines a seal with the valve seat 32 in the uppermost position of the valve 36.

The tubular body or stem 38 of the valve 36 also includes valve ports 50, preferably four such ports being provided, at equally spaced points thereabout proximate to and slightly spaced above or outward of the valve head 48. In this manner, the valve ports 50 are, in the closed position of the valve 36 with the valve head 48 against the valve seat 32, completely sealed from the contents of the cartridge.

The valve body 38 is of a length so as to, in the closed position of the valve as in FIG. 1, project outward beyond the outer end 24 of the mounting stub 20. An annular retaining lip 52, either integral with the exterior 40 of the valve body 38 or in the nature of a groove received 0-ring, is provided about the body 38 and so position as to immediately overlie the outer end 24 of the outer portion 22 of the mounting stub 20 with the valve fully seated in its outwardly shifted closed position. In this manner, the valve is retained in its closed position against accidental or unintentional opening. The nature of the retaining lip 52, as well as the inherent resilient flexibility of the mounting stub 20 and/or valve 36, which may be formed of the same material, is such as to allow an inward shifting of the valve 36 upon application of pressure to the outer end 42 thereof. As desired, the inner bore 30 of the mounting stub 20, at the appropriate height therein, can include a groove for receiving the retaining lip at the inner or open position of the valve 36. Alternatively, the retaining lip 52 can merely frictionally engage against and seal to the surface 30 with the relative resilient compressibility of the material basically allowing for a retention of the desired seal between the valve and the bore of the mounting stub 20.

Figure 2:
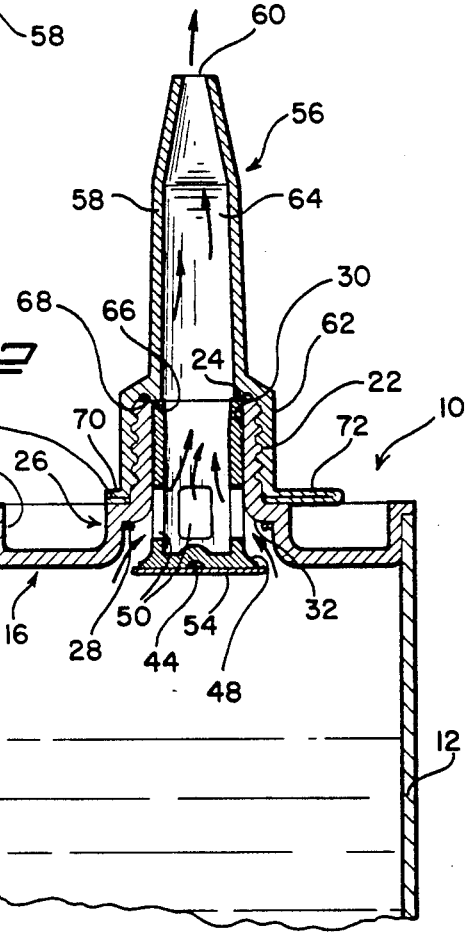
FIG. 2 is a similar view with the nozzle mounted and the cartridge open for content dispensing.
Figure 3:
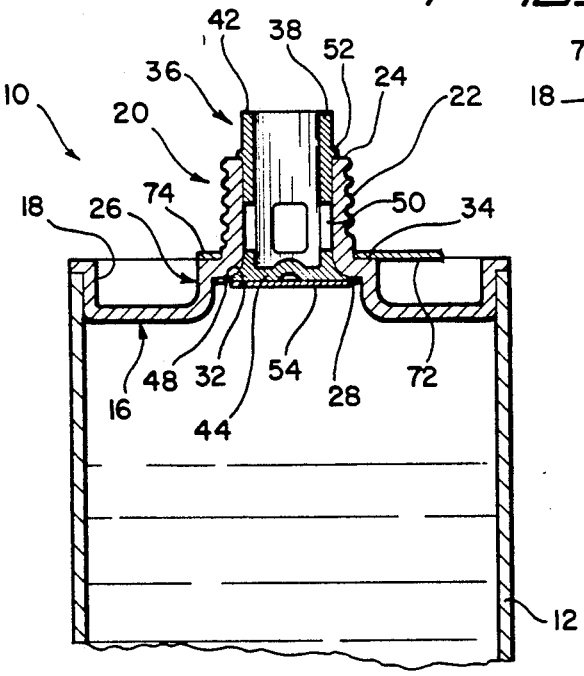
FIG. 3 is a similar view with the nozzle removed and the cartridge resealed.

The height of the valve 36 beyond the outer end 24 of the mounting stub 20 is such whereby, upon an inward movement of the valve 36 to a point of approximate alignment of the outer end 42 of the valve 36 with the outer end 24 of the stub 20, at least a major portion of the valve ports 50 will be positioned below the valve seat 32 and within the downwardly opening enlarged inner portion 26, as in FIG. 2, to define passages and enable free flow of pressurized cartridge contents through the valve.

Prior to an initial use of the cartridge 20, and in order to ensure maximum shelf life, an appropriate sealing membrane 54 underlies the inner capped end of the valve 36 and is peripherally sealed to the inwardly directed shoulder 28 peripherally about the defined valve seat 32. This membrane is such whereby a ready fracturing thereof will occur upon a forcible inward shifting of the valve 36 in a manner to be explained subsequently. As noted in FIG. 2, the pressure of the inner capped end of the valve 36 will effect a fracture of the membrane 54 annularly thereabout to allow for free flow of the contents.

The caulk cartridge includes a dispensing nozzle 56 comprising an elongate spout 58 terminating in an outer discharge end 60, and an enlarged cylindrical base or base end portion 62 internally threaded for threaded engagement with the externally threaded outer portion 22 of the mounting stub 20. The internal flow passage 64 through the spout 58 longitudinally aligns with the interior bore of the valve body 36 and provides a generally obstruction free continuation thereof for the smooth discharge of material. The inner end of this internal spout passage 64 terminates in an annular inwardly or downwardly directed bearing or pressure edge 66 defined by the outwardly enlarged integral base 62 and adapted to engage against the outer edge 42 of the valve 36. As illustrated, this bearing edge can be relieved, as at 68, radially outward thereof to ensure proper and continued contact with the valve edge 42 as this valve edge is moved inward toward and relative to the outer edge 24 of the mounting stub 20.

As will be appreciated from the described construction and the drawings, the nozzle is threaded onto the mounting stub 20 and inwardly advanced by rotation thereof to first engage the bearing edge 66 thereof against the outer edge 42 of the valve 36, and, upon a continued advancing of the nozzle, to exert such pressure on the valve as to inwardly move the valve to unseat the inner valve head 48, rupture the membrane 54, and expose the valve ports 50. Inward movement of the nozzle will overcome the resistance of the valve retaining lip 52 and will normally continue until the flared inner edge 70 of the nozzle base seats on the upwardly directed shoulder 34 of the inner portion 26 of the mounting stub 20.

Upon an opening of the valve 36, the contents of the cartridge 10 can be dispensed by a forward movement of the contents in a conventional manner, normally by advancing, by means of a piston type implement, a sliding rear closure plug (not illustrated). As suggested by arrows in FIG. 2, the discharge flow will enter the enlarged inner portion 26 of the stub 20 above and about the valve head 48 and flow outward through the ports 50.

If the contents are not completely dispensed, the cartridge is readily and effectively resealed. This is achieved by unscrewing the nozzle 56 to release the valve 36 for outward movement, and exerting dispensing pressure on the cartridge contents. This pressure will outwardly shift the now released valve 36 to reseat the valve head 48 on the valve seat 32, simultaneously repositioning the retaining lip 52 over the outer edge 24 of the mounting stub 20. In effecting this resealing, residue of the contents of the cartridge will be on the cooperating sealing surfaces and, in light of the conventional nature of such contents, ensure that a positive airtight seal is obtained. As will be appreciated, upon a reseating of the valve 36, the valve ports 50 themselves also seal against the inner bore 30 of the mounting stub 20. The nozzle, upon removal, can be readily flushed out or otherwise cleaned to avoid any hardening of the material therein, particularly at the restrictive discharge tip 60, and thus be appropriately available for reuse.

As the nozzle 56 is completely removable from the stub 20, it is preferred, to avoid misplacement, that the nozzle be tethered to the stub by a flexible strip 72 integrally connecting the nozzle and a ring 74 which rotatably encircles the stub 20.

With regard to a reseating of the valve 36, upon removal of the nozzle 56 and in response to internal pressure within the cartridge, it will be appreciated that the area of the end cap 44 of the valve 36 is such that pressure thereagainst exceeds pressure thereabove so as to result in the desired outward movement of the valve 36 to its seated position. It will also be recognized that the valve 36, in its inwardly shifted or open position, is retained in position against free inward movement both by frictional engagement with the bore 30 of the mounting stub 20 and by the internal pressure of the cartridge contents.

Figure 4:
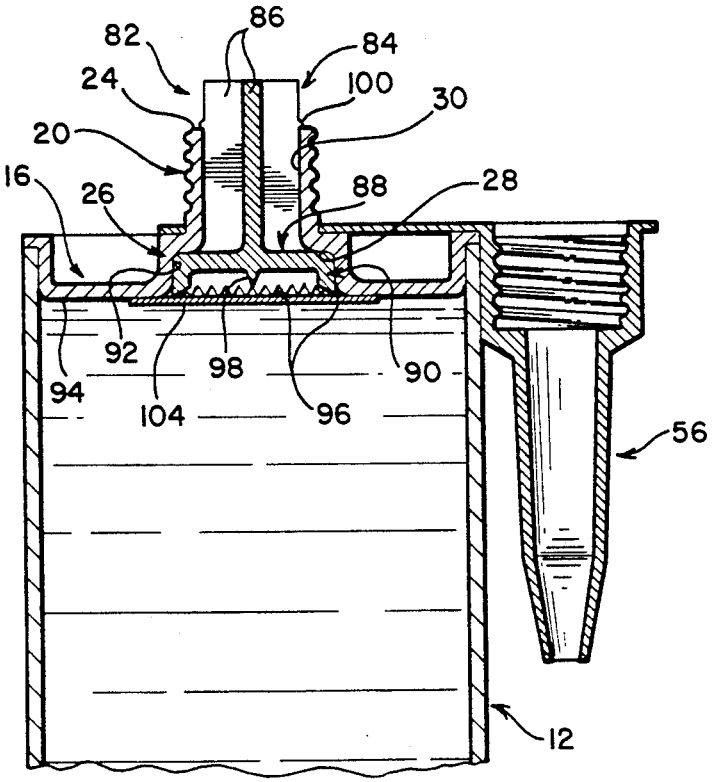
FIG. 4 is a cross-sectional view of another embodiment prior to its initial use.
Figure 5:
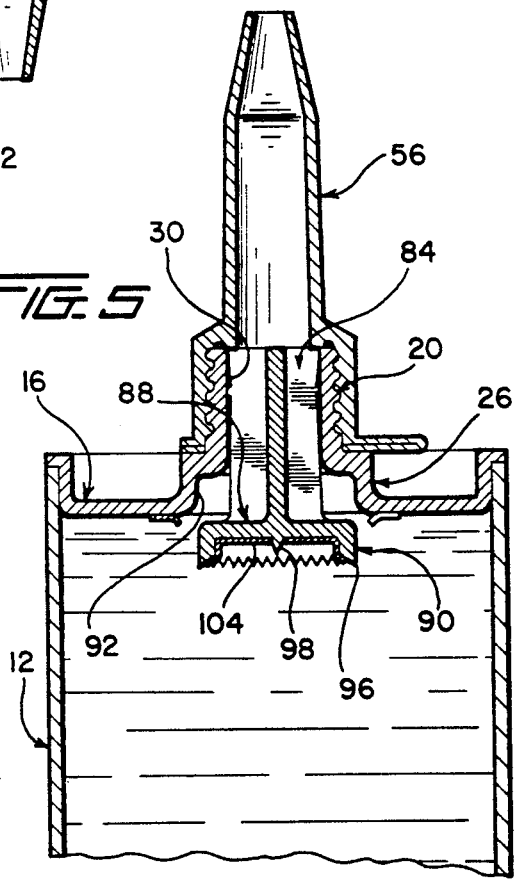
FIG. 5 is a similar view with the nozzle mounted and the cartridge open for dispensing.
Figure 6:
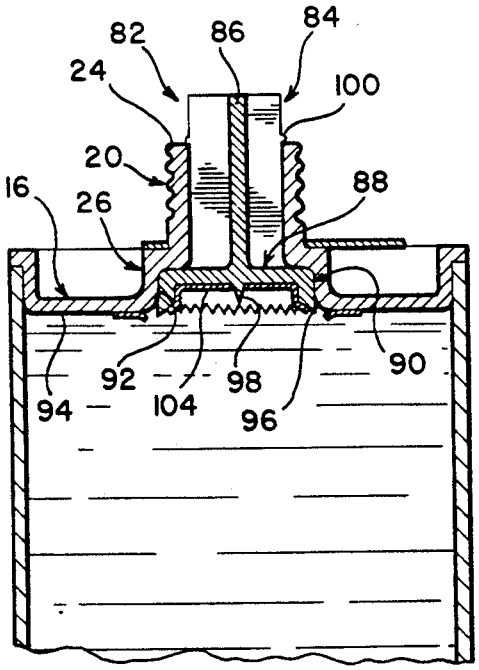
FIG. 6 is a similar view with the nozzle removed and the cartridge resealed.

Referring now to FIGS. 4, 5 and 6, another embodiment of the invention is illustrated. In this embodiment like parts have been designated by like reference numerals whereby the similarities between the embodiments will be more readily recognized.

This second embodiment differs principally in the construction of the valve or valve insert 82 which, while being operationally functional substantially in the manner of the first described valve, structurally differs therefrom.

More particularly, the valve 82 has an elongate stem 84 which is cruciform in cross section and of a constant cross-section throughout the height thereof. The outer edges of the cross arms 86 of the stem 84 are smooth surfaced, and slidably seal to the interior bore 30 of the mounting stub 20. The cruciform configuration of the stem 84 defines four longitudinal flow passages along the stem and within the bore 30.

A circular valve head 88 is integral with the lower end of the stem 84 with the stem projecting centrally therefrom. The valve head 88 is, in the closed position of the valve of FIG. 4, upwardly received within the hollow cylindrical inner portion 26 and engaged with the downwardly directed annular shoulder 28 at the lower end of the bore 30.

The valve head 88 includes an integral downwardly depending peripheral flange 90, the outer circumferential surface of which engages, with a light interference or frictional fit, with the annular inwardly directed wall 92 of the cylindrical portion 26 below the shoulder 28, and between the shoulder 28 and the flat inner surface 94 of the closure plate 16. The height of the valve head flange 90 and the cooperating surface 92 can vary in accord with the length of the seal desired or required by the contents of the cartridge 10. The valve head 88 defines an end cap, similar to the end cap 44 of the valve 36, closing the lower ends of the passages defined by the cruciform stem 84.

The lower downwardly directed annular edge 96 of the valve head flange 90 is serrated and beveled toward the outer peripheral surface of the flange 90 to define a sharpened or cutting edge. In addition, the valve head 88, coaxial therewith, includes an integral depending retaining spike 98 of a lesser height than the depending flange 90.

In the closed position of the valve 82, the stem 84 projects upwardly or outwardly beyond the outer end 24 of the mounting stub 20, and is releasably retained by small retaining lips 100 which overlie the outer end 24, much in the manner of the retaining lip 52 of the valve 36. It is preferred that a lip 100 be provided on the outer edge surface of each stem arm 86.

In this outermost position of the valve 82, as in FIG. 4, the valve head 88, including the upper surface thereof and the outer face of the depending flange 90, engage and seat against the downwardly directed shoulder 28 and inwardly directed surface 92, which define the valve seat. The serrated lower edge 96 of the valve head flange 90 is positioned slightly above the lower or inner face 94 of the closure plate 16.

In order to ensure maximum shelf life, prior to the initial use of the cartridge, an appropriate sealing membrane 104, for example a plastic/foil laminate, can be provided in underlying relation to the closed valve 82. The membrane 104, as noted in FIG. 4, will peripherally seal to the inner face 94 of the plate 16 and, in conjunction with the closed valve, effectively prevent any seepage or leakage of air into the cartridge or contents from the cartridge.

In opening the cartridge for material dispensing, as previously described by a mounting of the nozzle 56, the valve 82 is forced downwardly with the serrated lower edge 96 providing for a positive severing or fracturing of the membrane 104 evenly thereabout and in a manner which avoids irregular tearing of the membrane which might interfere with a resealing of the valve.

With the valve in its open position, as in FIG. 5, the contents of the tube 12, upon pressurization, can flow freely about the inwardly spaced valve head 88, through the valve stem passages, and out the nozzle.

Upon a pressurization of the tube contents, the severed laminate or membrane 104 will be forced onto the inwardly directed central spike 98. This will ensure a stabilization of the severed membrane within the slightly cupped or cupped-shaped valve head 88. This in turn will effectively preclude any possibility of the membrane being entrained with the discharging flow of material and disrupting the flow, becoming lodged within the valve seat When the cartridge is to be resealed, as with the first described embodiment, the nozzle 56 is removed, releasing the retaining pressure on the upper end of the valve stem 84. Upon release of the valve for outward movement, dispensing pressure is exerted on the cartridge contents. This pressure will outwardly shift the released valve 82 to reseat the valve head 88 and flange 90 thereof on the valve seat, defined by the shoulder 28 and surface 92. There will be no possibility of the severed membrane 104 interfering with this reseating in light of the manner which the membrane is "captured" by the spike 98 and flange 90. The reseated valve has been illustrated in FIG. 6.

From the foregoing, it will be appreciated that a caulk cartridge has been disclosed wherein the nozzle removably mounts in a manner whereby a mounting of the nozzle effects an automatic opening of the cartridge for discharge of the contents and wherein removal of the nozzle effects a release of the flow control valve for a simplified resealing of the cartridge.

The foregoing preferred embodiments are illustrative of the principles of the invention, and as other embodiments incorporating the inventive features of the invention may occur to those skilled in the art, the disclosed embodiments are not to be considered as limitations on the scope of the invention.

I claim:

1. For use in a tubular dispensing cartridge defining a container for flowable material and having a discharge end; an end closure for the discharge end including a closure plate having opposed inner and outer sides, and a mounting stub fixed to said plate and extending laterally therefrom, said mounting stub having inner and outer ends opening respectively to the inner and outer sides of said closure plate, a passage defined longitudinally through said mounting stub between and through said inner and outer ends thereof and providing flow communication through said end closure; a valve longitudinally reciprocal within said passage between a closed position precluding flow through said passage and an open position allowing flow through said passage, and a valve seat on said end closure, said valve, in said closed position, sealing to said valve seat, said valve, in said open position, being remote from said valve seat; and dispensing nozzle means, said nozzle means and said mounting stub including cooperating means for mounting said nozzle means to said stub in alignment with said passage and for reciprocal movement of said nozzle means on said stub to and between first and second positions, said nozzle means in said second position being forcibly engaged with said valve and retaining said valve in said open position thereof, said nozzle means in said first position being retracted from said valve and allowing movement of said valve to said closed position 2. The assembly of claim 1 wherein said valve includes inner and outer ends corresponding to said inner and outer ends of said mounting stub, said valve seat being defined in said mounting stub passage proximate said inner end of said mounting stub, said valve inner end having a valve head defined thereat and engageable with said valve seat in said closed position, said nozzle means in said first position thereof being outwardly positioned on said mounting stub, said nozzle means being inwardly movable to said second position thereof, said nozzle means including abutment means thereon engageable with said outer end of said valve for inward movement of said valve and movement of said valve head away from said valve seat in response to inward movement of said nozzle means to said second position thereof.

3. The assembly of claim 2 wherein said nozzle means includes a base end telescopically received over said mounting stub, said means for mounting said nozzle means to said stub comprising external threads on said stub and cooperating internal threads on said nozzle base end whereby rotation of said nozzle means relative to said mounting stub effects said reciprocal movement of said nozzle means.

4. The assembly of claim 3 wherein said mounting stub includes an inner portion adjacent said inner end of said stub, said inner portion being integral with said closure plate centrally thereof, said stub inner portion receiving said valve head therein, said mounting stub including an outer portion coaxial with said inner portion, said passage defined through said stub extending longitudinally through said inner and outer portions of said stub, said valve seat being defined within said inner portion of said stub, said stub passage within said stub outer portion slidably receiving said valve in intimate engagement therewith.

5. The assembly of claim 4 including a fracturable sealing membrane overlying said valve head and said valve seat immediately inward thereof for engagement and severing by said valve head upon movement of said valve head away from said valve seat.

6. The assembly of claim 5 wherein said valve includes an elongate valve stem extending outward from said valve head, said stem having flow passage means defined therealong.

7. The assembly of claim 6 wherein said valve stem is of a constant cruciform cross section outward from said valve head.

8. The assembly of claim 6 wherein said valve stem is tubular, said flow passage means being defined longitudinally through said stem and opening through said outer end of said valve, and lateral flow ports through said valve stem proximate said valve head and communicating with said flow passage means through said valve stem.

9. The assembly of claim 8 wherein said valve stem ports are closed by said stub outer portion upon seating of said valve head on said valve seat.

10. The assembly of claim 5 wherein said nozzle means is completely removable from said mounting stub, and tether means tethering said nozzle means to said mounting stub for movement relative thereto.

11. The assembly of claim 2 wherein said mounting stub includes an inner portion adjacent said inner end of said stub, said inner portion being integral with said closure plate centrally thereof, said stub inner portion receiving said valve head therein, said mounting stub including an outer portion coaxial with said inner portion, said passage defined through said stub extending longitudinally through said inner and outer portions of said stub, said valve seat being defined within said inner portion of said stub, said stub passage within said stub outer portion slidably receiving said valve in intimate engagement therewith.

12. The assembly of claim 11 including a fracturable sealing membrane sealed to said closure plate inward of said valve seat and said valve head for selective fracturing upon movement of said valve head away from said valve seat.

13. The assembly of claim 12 including means on said valve head for uniformly fracturing said membrane peripherally about said valve head.

14. The assembly of claim 13 including means for capturing and retaining the fractured membrane on said valve head and precluding relative movement therebetween.

15. The assembly of claim 14 wherein said means for uniformly fracturing said membrane comprises a peripheral flange on said valve head inwardly directed toward said membrane, said flange including a sharpened inner edge continuously thereabout.

16. The assembly of claim 15 wherein said sharpened inner edge is serrated.

17. The assembly of claim 14 wherein said means for capturing said membrane comprises a spike rigid with said valve head centrally thereof and inwardly directed toward said membrane for engagement through said membrane subsequent to fracture thereof.

18. The assembly of claim 2 including a fracturable sealing membrane sealed to said closure plate inward of said valve seat and said valve head for selective fracturing upon movement of said valve head away from said valve seat, said valve head including means for fracturing said membrane upon movement of said valve head away from said valve seat, and including means for capturing and retaining the fractured membrane on said valve head and precluding relative movement therebetween, said means for capturing said membrane comprising a spike rigid with said valve head centrally thereof and inwardly directed toward said membrane for engagement through said membrane subsequent to fracture thereof.

19. A dispensing cartridge for flowable material comprising an elongate hollow tube having a discharge end; an end closure on said discharge end, said end closure including a closure plate overlying said discharge end and having opposed inner and outer sides, and a mounting stub fixed to said plate and extending outward therefrom relative to said tube, said mounting stub having inner and outer ends opening respectively to the inner and outer sides of said closure plate, a passage defined longitudinally through said mounting stub between and through said inner and outer ends thereof and providing flow communication from said tube through said end closure; a valve seat defined about said passage, valve means longitudinally reciprocal within said passage between a closed position precluding flow through said passage and an open position allowing flow through said passage, said valve means, in said closed position, sealing to said valve seat, said valve means, in said open position, being spaced from said valve seat; and dispensing nozzle means, said nozzle means and said mounting stub including cooperating means for mounting said nozzle means to said stub in alignment with said passage and for reciprocal movement of said nozzle means on said stub to and between first and second positions, said nozzle means in said second position being forcibly engaged with said valve means and retaining said valve means in said open position thereof, said nozzle means in said first position being retracted from said valve means to allow movement of said valve means to said closed position.

20. The assembly of claim 19 wherein said valve means has inner and outer ends corresponding to said inner and outer ends of said mounting stub, said valve means inner end being closed and having a valve head defined thereat and engageable with said valve seat in said closed position, and flow passage means defined longitudinally along said valve means from said closed inner end and opening through said outer end of said valve means.

21. The assembly of claim 20 wherein said nozzle means in said first position thereof is outwardly positioned on said mounting stub, said nozzle means being inwardly movable to said second position thereof, said nozzle means including abutment means thereon engageable with said outer end of said valve means for inward movement of said valve means and movement of said valve head away from said valve seat in response to inward movement of said nozzle means to said second position thereof.

22. The assembly of claim 20 wherein said valve means, outward from said closed inner end, is of a constant cruciform cross section defining said flow passage means.

23. The assembly of claim 20 including a fracturable sealing membrane sealed to said closure plate inward of said valve seat and said valve head for selective fracturing upon movement of said valve head away from said valve seat, said valve head including a peripheral flange inwardly directed toward said membrane, said flange having an outer edge configured to uniformly fracture said membrane peripherally thereabout upon movement of said valve head from said valve seat, and means on said valve head for engaging and retaining said membrane upon fracture thereof.

* * * * *